United States Patent [19]

Hand

[11] 3,963,426

[45] June 15, 1976

[54] PROCESS FOR GASIFYING CARBONACEOUS MATTER

[75] Inventor: John W. Hand, Aurora, Colo.

[73] Assignee: Cameron Engineers, Incorporated, Denver, Colo.

[22] Filed: July 22, 1974

[21] Appl. No.: 490,775

[52] U.S. Cl. ..... 48/197 R; 48/202; 48/206; 48/210; 252/373

[51] Int. Cl.[2] ..... C10J 1/00

[58] Field of Search ..... 48/202, 197 R, 206, 48/210; 252/373

[56] References Cited

UNITED STATES PATENTS

| | | | |
|---|---|---|---|
| 2,633,416 | 3/1953 | Gornowski et al. | 48/203 |
| 3,009,795 | 11/1961 | Atwell | 48/206 |
| 3,692,505 | 9/1972 | Reichl | 48/202 |
| 3,761,233 | 9/1973 | Wenzel et al. | 48/202 |
| 3,871,839 | 3/1975 | Moody | 48/197 R |

*Primary Examiner*—Robert L. Lindsay, Jr.
*Assistant Examiner*—George C. Yeung
*Attorney, Agent, or Firm*—Burton, Crandell & Polumbus

[57] ABSTRACT

A process for the gasification of coal and other carbonaceous materials in which solid particulate carbonaceous material is dried without pyrolysis or oxidation by direct contact with a fluent stream of hot synthesis gas product. The dried carbonaceous material is separated from the moist synthesis gas, water is removed from the moist gas and converted to steam, and the steam is mixed with oxygen bearing gas and reacted with the dried carbonaceous material to produce synthesis gas and an ash residue. The oxygen and steam mixture is heated by direct contact with the ash residue, while the hot synthesis gas is utilized to dry the incoming particulate carbonaceous material. Synthesis gas containing hydrogen and carbon oxides is recovered from the process.

5 Claims, 1 Drawing Figure

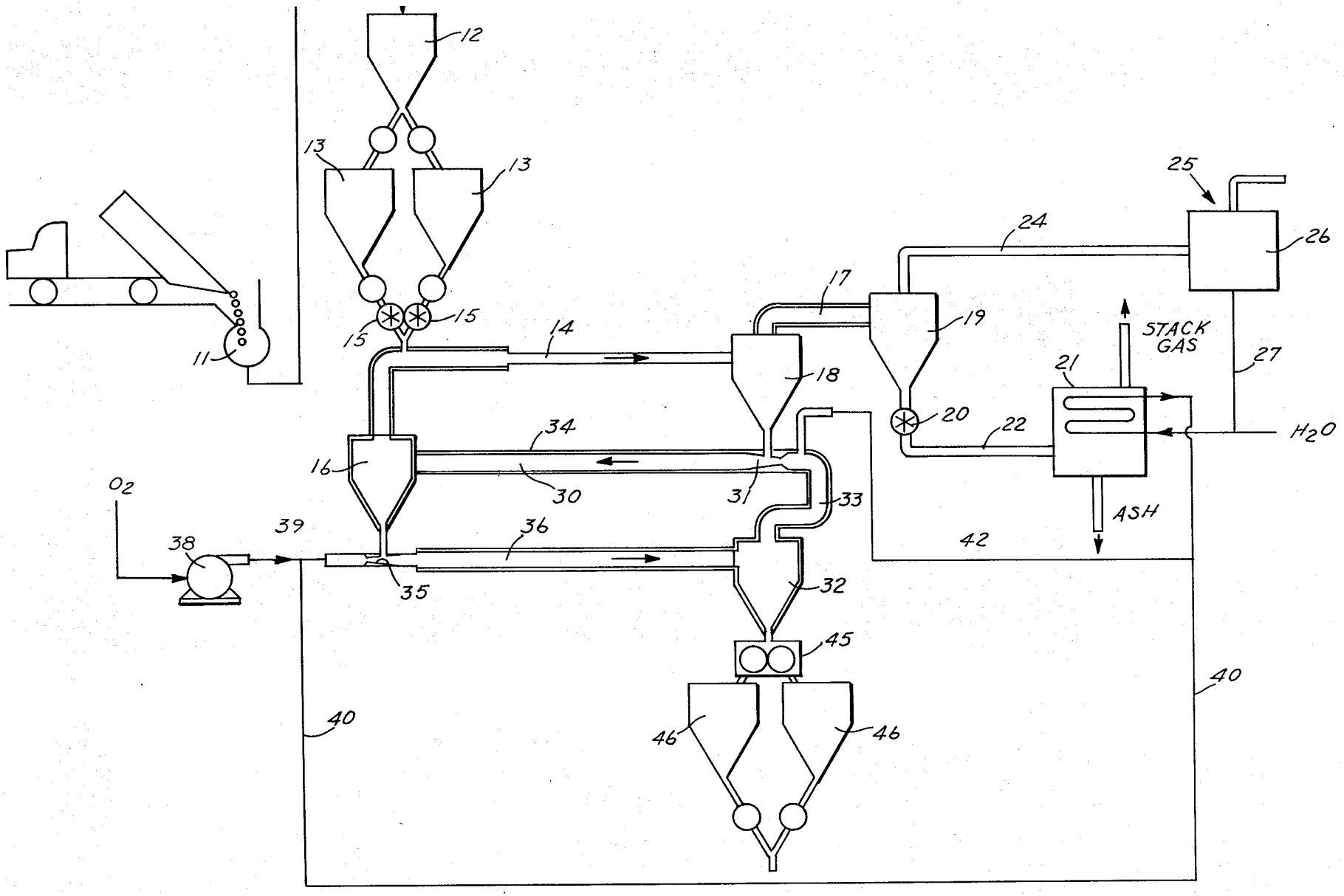
26
25
27
$H_2O$
STACK GAS
ASH
21
24
22
19
20
42
40
17
18
33
32
45
46
46
31
14
34
30
36
12
13
13
15
15
35
16
39
40
11
38
$O_2$

PROCESS FOR GASIFYING CARBONACEOUS MATTER

FIELD OF THE INVENTION

The present invention relates to the gasification of solid carbonaceous materials, and more particularly to the manufacture of synthesis gas from solid carbonaceous fuels.

PRIOR ART

The gasification of coal and other carbonaceous materials is an ancient and well known art. More recently, natural gas and petroleum have been widely used as fuels and sources of hydrocarbons for manufacturing operations. Shortages of natural gas and petroleum, however, have resulted in a renewed interest in coal as a natural resource. A discussion of the past technology of gasification of coal may be found in Perry, H., "The Gasification of Coal," *Scientific American*, Vol. 230, No. 3, pages 19–25, March, 1974; Osborn, E. F., "Coal and the Present Energy Situation", *Science*, Vol. 183, No. 4124, pages 477–481, Feb. 8, 1974; and Conn, A. L., "Low B.T.U. Gas for Power Plants," *Chemical Engineering Progress*, Vol. 69, No. 12, pages 56–61, December, 1973.

OBJECTS OF THE INVENTION

The principal object of the present invention is to provide an improved process for the continuous gasification of solid carbonaceous fuels including coal, lignite, char, wood wastes, manure, and municipal solid carbonaceous wastes, to produce a synthesis gas suitable for use as a fuel or for further processing and containing principal amounts of hydrogen, carbon oxides, and water vapor.

Another object of the present invention is to provide a process of the foregoing character which maximizes the production of carbon monoxide and hydrogen, and minimizes the production of coal tars, acids, and other condensable by-products.

Still another object of the invention is to provide an improved process for producing a low cost synthesis gas from which a substitute for natural gas can be produced such as a synthesis gas useful in a subsequent methanation process.

A further object of the present invention is to provide a new and improved process for producing synthesis gas from solid carbonaceous materials, which process eliminates the need for preconditioning the carbonaceous material to remove constituents which cause caking or agglomeration and consequent fouling of the gasification apparatus.

Still another object of the present invention is to provide a process of the foregoing character which affords instantaneous temperature control in the gasifier reaction apparatus.

Still a further object of the present invention is to provide a process which utilizes the water inherent in the carbonaceous matter as a source of condensate for the production of steam consumed in the gasification reactions.

Other objects and advantages of the present invention will become apparent as the following description proceeds, taken in conjunction with the accompanying drawing.

DESCRIPTION OF THE DRAWING

The FIGURE of the drawing is a schematic flow diagram illustrating the process of the present invention.

SUMMARY OF THE INVENTION

In accordance with the foregoing objects, a finely divided, solid, carbonaceous material, for example, coal, lignite, saw dust, manure, char, or other suitable carbonaceous source material, is dried without pyrolysis or oxidation in a stream of hot synthesis gas, manufactured in the process, in a tubular dryer. The dried carbonaceous material, after separation from the moist synthesis gas stream, is fed to a horizontal tubular reactor in which it is converted to synthesis gas by partial combustion and simultaneous gasification within a fluent, highly turbulent, stream of oxygen or air and steam. The process may be carried out at atmospheric pressure or at a higher pressure determined according to the intended subsequent processing of the synthesis gas. Although the synthesis gas manufactured by the process, which consists primarily of hydrogen, carbon oxides and water vapor, with minor contaminants, can be used directly as a fuel, it finds particular but not necessarily exclusive utility as a source as feed gas for the synthesis of methanol and methane. The process of the present invention further maximizes the production of carbon monoxide and hydrogen gases, and minimizes the production of coal tars, acids, and other condensable by-products which cause complications in subsequent synthesis operations.

DESCRIPTION OF THE PREFERRED EMBODIMENT

In accordance with the present invention, a solid carbonaceous material, for example coal, lignite, saw dust or other wood waste, manure, char, paper, or municipal solid carbonaceous waste, is ground or pulverized to a finely divided form, and the particulate material is dried without pyrolysis or oxidation in the hot fluent stream of the synthesis gas manufactured in the process. The dried particulate carbonaceous material is then fed to a closed system in which it is heated to a temperature sufficient to produce synthesis gas by a process of partial combustion and simultaneous gasification within a fluent stream of oxygen or air mixed with steam. The process may be carried out at atmospheric pressure, about 15 p.s.i.a., or at higher pressures, up to in the vicinity of 2000 p.s.i.a., depending upon the composition of the synthesis gas desired. The gas composition desired is in turn determined by the intended use and subsequent processing of the synthesis gas. The temperature within the gasification zone is generally in the range of 1000°to 1250°C.

In the production of synthesis gas having a composition useful for the production of methanol and methane, the molecular ratio of hydrogen ($H_2$) to carbon monoxide (CO) must be in the order of two-to-one or higher. This requires that water vapor be one of the reactants with the coal or other carbonaceous matter to provide the hydrogen. It is known that the action of steam at high temperature on carbon or carbonaceous material taken to red heat proceeds by the following basic reactions wherein the conditions of equilibrium depend upon the prevailing temperature and pressure:

$$H_2O + C \rightarrow CO + H_2 - 28.8 \text{ K. cal. per mole} \quad (1)$$

$$H_2O + CO \rightarrow H_2 + CO_2 - 14.8 \text{ K. cal. per mole} \quad (2)$$

Above 1000°C., the dominant reaction follows equation (1). To produce a gas rich in hydrogen according to equations (1) and (2), two molecules of water are required to react with one molecule of carbon. The weight of water required to gasify the carbon can range from 1.5 pounds of water per pound of carbon for equation (1) to twice that amount for a complete reaction to produce hydrogen and carbon dioxide. Accordingly, a large source of process water is needed for synthesis gas production. By utilizing a carbonaceous material which has a high water content, a substantial portion, if not all, of the water required can be obtained by initially drying the moist, particulate, carbonaceous material by contact with the hot synthesis gas, separating the water from the synthesis gas by condensation, and utilizing the water to form steam for reaction with the dried particulate carbonaceous material in an oxygen atmosphere.

In order to reduce or eliminate the problem of caking or agglomeration of the carbonaceous material at the reaction temperature, violent, highly turbulent flow of the carbonaceous particles in a fluent system is utilized in a horizontal tubular reactor. Moreover, the carbonaceous material is subjected to an extremely short reaction time so that the ash is prevented from fusing and sticking to the reactor surfaces. The flow of the fluent bed of particulate material, steam and oxygen bearing gas is at the rate of greater than 40 feet per second and the time response is quite short, generally in the nature of a fraction of a second. The reaction conditions can be quickly varied by varying the proportions of oxygen bearing gas, steam and carbonaceous material introduced into the tubular reactor.

Turning for more specific detail to the accompanying drawing, there is shown a schematic diagram of a process embodying the present invention. The carbonaceous material such as coal, lignite, wood refuse, paper or other carbonaceous matter, is first reduced to a particle size which will allow the particles to be entrained in a turbulent gas stream moving with a velocity in excess of 40 feet per second. The preferred particle size has been found to be on the order of one-half inch or less, and is accomplished in a crusher or shredder 11. The carbonaceous particles are then elevated to a feed hopper 12 from which the carbonaceous material is introduced, in a controlled stream, through a pair of lock hoppers 13, into a tubular dryer 14. The gasification system is generally maintained at a pressure above atmospheric, and the lock hoppers 13 allow the particulate matter to be fed into the system at a pressure greater than atmospheric by means of star valves 15.

As the particulate carbonaceous material enters the dryer tube 14, it is picked up in a rapidly moving stream of synthesis gas exiting from a cyclone separator 16, at a temperature in the range of approximately 750°to 1000°C. The length of the dryer tube 14 is such that the carbonaceous particulate material remains in contact with the hot synthesis gas stream for one second or slightly more. During this time, the surface moisture and most of the water of constitution in the carbonaceous material is evaporated without pyrolysis or oxidation of the carbonaceous material. This evaporation of moisture and the heating of the dried carbonaceous particulate material reduces the temperature in the transporting synthesis gas stream and simultaneously increases the dew point thereof. About 90% of the preheated particulate carbonaceous material is separated from the synthesis gas stream in a cyclone separator 18. The synthesis gas and the balance of the carbonaceous matter, principally fines, passes out of the top of the cyclone separator and flows through a conduit 17 to a high efficiency cyclone separator 19 where again more than 90% of the remaining particulate matter is removed from the synthesis gas stream. The fine particulate matter collected in the cyclone 19 is metered out of the system through a star valve 20 along with some small leakage of synthesis gas, and is fed directly to a steam generating boiler 21 through a feed pipe 22, where it is used as a fuel.

The synthesis gas exiting the process through pipe 24 is near its water saturation temperature and is fed directly to a scrubbing system 25 to complete clean up of particulate matter entrained in it and otherwise prepare it for processing into methanol or methane or for direct use as a fuel gas. The scrubbing system includes a condensor 26 which removes and collects the water evaporated from the moist, carbonaceous material in the dryer 14. The water from the condensors 26 is fed to the steam boiler 21 through line 27, together with any make-up water.

The dried and preheated carbonaceous matter collected in the cyclone separator 18 falls by gravity into a horizontal tubular reactor or gasifier 30 where it is entrained, by means of a venturi 31, in a hot, highly turbulent stream of a mixture of steam and oxygen bearing gas issuing from the top of a cyclone separator 32, through a conduit 33. The stream of oxygen bearing gas and steam is moving at a velocity in excess of 40 feet per second which is sufficient, as it passes through the venturi 31, to entrain the dried carbonaceous matter entering the tubular reactor 30 and maintain the matter in suspension in a turbulent stream.

The horizontal tubular gasification reactor 30 is lined with a refractory material 34 and is of a length sufficient to give the carbonaceous matter and oxygen-steam gasification mixture a contact time of about 1 second or slightly longer. During this time interval, 90% or more of the carbon in the carbonaceous matter is converted to synthesis gas. A portion of the carbonaceous matter is burned to raise the maximum temperature in the reactor 30 to about 1250°C. Because the gasification reaction is endothermic, as shown in equation (1) above, the temperature is reduced to approximately 1000°C. or slightly less, at the exit end of the reactor 30.

From the exit end of the reactor 30 the gas stream with entrained ash, remaining carbon materials and synthesis gas, is passed into the cyclone 16. The cyclone 16 is refractory lined and serves to separate the solid materials from the synthesis gas, the latter being fed to the tubular dryer 14 from the top of the cyclone 16.

The ash, containing some residual carbon, is separated in the separator 16 from the synthesis gas stream and drops by gravity into a venturi throat 35 of an ash cooling tubular finisher 36. As the ash enters the venturi section 35 of the ash finisher 36 it is entrained in a blast of a mixture of cold oxygen bearing gas issuing from a compressor 38 through a conduit 39, and of steam issuing from the boiler 21 through steam line 40. Additional steam from the boiler 21 may be introduced directly into the gasifier reactor 30 through steam line 42.

In the ash finisher, the residual carbon in the ash product is oxidized and gasified. The ash, besides being cleaned of its carbon content, is cooled and simultaneously the mixture of oxygen bearing gas and steam is heated to a temperature of about 700°C. The ash is separated from the gaseous stream in a cyclone separator 32 and falls by gravity to a receiver 45 from which it is removed from the gasifier system through pressure reducing lock hoppers 46. The spent ash, together with ash from the steam generating boiler 21 is disposed of or sent to further processes.

In addition to water derived from the moist incoming carbonaceous matter, additional make up water may be added to the steam boiler 21. In many instances, there is more than enough water contained in the carbonaceous matter being fed to the gasifier to supply the steam requirements for the gasification reactions.

EXAMPLE

Lignite having a composition as shown in Table 1

TABLE 1

| Element | Lignite Proximate Analysis Weight % | Flow Rate lbs/hr. |
|---|---|---|
| Volatile Matter | 26.0 | 51,027 |
| Fixed Carbon | 24.3 | 47,690 |
| Ash | 13.4 | 26,299 |
| Moisture | 36.3 | 71,241 |
| Total | 100.0 | 196,257 |

is fed to the dryer section at the rate of 196,257 pounds per hour, where it is dried in a synthesis gas stream at an inlet temperature of 990°C. The lignite is dried to essentially zero moisture but without pyrolysis or oxidation of the carbonaceous matter. Ninety percent of the dried lignite, having an ultimate analysis shown in Table 2,

TABLE 2

| Element | Dried Lignite Ultimate Analyses (To Gasifier) Weight % | Flow Rate lbs/hr. |
|---|---|---|
| C | 55.9 | 63,170 |
| $H_2$ | 3.8 | 4,290 |
| $N_2$ | 1.2 | 1,360 |
| $O_2$ | 18.0 | 20,340 |
| Ash & Sulfur | 21.1 | 23,840 |
| Total | 100.0 | 113,000 |

is then fed to the gasifier section at an inlet temperature of 232°C. where it is entrained with a gaseous mixture comprised of steam, oxygen and some products of combustion issuing from the ash finisher—cooler section at an inlet temperature of 438°C., the gaseous mixture having a composition as shown in Table 3.

TABLE 3

| Element | Reactant Gas Composition Weight % | Volume % | Flow Rate lb/hr. |
|---|---|---|---|
| $CO_2$ | 3.5 | 1.7 | 4,650 |
| $N_2$ | .2 | .2 | 295 |
| $O_2$ | 39.3 | 27.5 | 51,670 |
| $H_2O$ (gas) | 57.0 | 70.6 | 75,000 |
| Total | 100.0 | 100.0 | 131,615 |

In the gasifier section, the dried lignite and the hot oxygen-steam mixture react, and a portion of the lignite burns to increase the temperature to reaction level of about 1250°C. The dried lignite and the hot oxygen-steam mixture react to produce 219,505 pounds per hour of synthesis gas having a composition shown in Table 4.

TABLE 4

| Element | Hot Synthesis Gas Composition Weight % | Volume % | Flow Rate lb/hr. |
|---|---|---|---|
| CO | 50.7 | 34.2 | 111,440 |
| $H_2$ | 3.6 | 34.2 | 7,960 |
| $CO_2$ | 25.7 | 11.1 | 56,480 |
| $N_2$ | .8 | .5 | 1,655 |
| $H_2O$ | 19.2 | 20.0 | 41,970 |
| Total | 100.0 | 100.0 | 219,505 |

Dried lignite, in the amount of 12,016 pounds per hour not collected by the primary cyclone separator following the tubular drier section is collected in the high efficiency cyclone and is fed to a boiler plant to produce 75,000 pounds per hour of dry steam at 383°C. and 450 p.s.i.a., which are the operating conditions for the gasifier system. The amount of 99.5% purity oxygen required in the process is 55,345 pounds per hour at an input temperature of 21°C. and a pressure of 450 p.s.i.a.

Cool, moist synthesis gas issuing from the dryer section has a composition as shown in Table 5.

TABLE 5

| Element | Cool Synthesis Gas Composition Weight % | Volume & | Flow Rate lb/hr. |
|---|---|---|---|
| CO | 38.5 | 25.6 | 111,440 |
| $H_2$ | 2.5 | 25.6 | 7,960 |
| $CO_2$ | 19.1 | 8.1 | 56,480 |
| $N_2$ | .6 | .4 | 1,655 |
| $H_2O$ | 39.0 | 40.3 | 113,211 |
| Total | 100.0 | 100.0 | 290,746 |

This product gas has a gross heating value of 163 BTU per standard cubic foot, a saturation temperature of 190°C., and a partial pressure of water vapor of 181 p.s.i.a.

While an illustrative embodiment of the process of the present invention has been described in considerable detail it should be understood that there is no intention to limit the invention to the specific form disclosed. On the contrary, it is the intention to cover all modifications, equivalents, alternatives and uses of the present invention falling within the spirit and scope of the invention as expressed in the appended claims.

I claim:

1. A process for producing synthesis gas from the reaction of solid particulate carbonaceous material with oxygen and steam, wherein the improvement comprises the steps of:

a. drying the solid particulate carbonaceous material to essentially zero water content without pyrolysis or oxidation by direct contact with a fluent stream of hot synthesis gas product from step (g);
b. separating the dried carbonaceous material from the moist synthesis gas;
c. removing the water from the moist synthesis gas from step (b) and heating said water to form steam;
d. mixing said steam with oxygen;
e. heating said steam and oxygen mixture by direct fluent stream contact with hot ash residue from step (g);
f. contacting said dried carbonaceous material directly with said heated steam and oxygen mixture produced in step (e) thereby to gasify said carbonaceous material to produce a hot fluent stream of synthesis gas product and ash residue;

g. separating said hot synthesis gas product from said hot ash residue; and h. recovering synthesis gas product from step (c).

2. The process as defined in claim 1 wherein the improvement further comprises maintaining the temperature in step (f) at between about 1000°and about 1250°c.

3. The process as defined in claim 1 where the improvement further comprises maintaining a pressure in the gasification system of from about 15 p.s.i.a. to about 2000 p.s.i.a.

4. The process as defined in claim 1 further including the step of adding additional water to form steam in an amount sufficient to react with the carbonaceous material to produce the desired composition of the synthesis gas product.

5. The process as defined in claim 1 wherein said carbonaceous material is coal, lignite, wood refuse, paper, manure, or municipal solid carbonaceous waste.

* * * * *